US010315671B2

(12) United States Patent
Sakahira et al.

(10) Patent No.: US 10,315,671 B2
(45) Date of Patent: Jun. 11, 2019

(54) RESTRICTING MEMBER AND RAILCAR INCLUDING RESTRICTING MEMBER

(71) Applicant: KAWASAKI JUKOGYO KABUSHIKI KAISHA, Kobe-shi, Hyogo (JP)

(72) Inventors: Masahiro Sakahira, Akashi (JP); Kazuo Isomura, Kobe (JP); Takanori Tojo, Akashi (JP); Satoshi Ikeda, Kobe (JP); Tomohide Maeba, Akashi (JP); Naoki Hikosaka, Kobe (JP); Tomohiro Narita, Kobe (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 253 days.

(21) Appl. No.: 15/350,199

(22) Filed: Nov. 14, 2016

(65) Prior Publication Data

US 2017/0129508 A1 May 11, 2017

(30) Foreign Application Priority Data

Nov. 11, 2015 (JP) ..... 2015-221472

(51) Int. Cl.
*B61F 5/10* (2006.01)

(52) U.S. Cl.
CPC ..... *B61F 5/10* (2013.01)

(58) Field of Classification Search
CPC ..... B61F 5/10; B61F 5/36; B61F 5/16; B61F 5/18; B61F 5/20
USPC ..... 248/125.1
See application file for complete search history.

(56) References Cited

U.S. PATENT DOCUMENTS

| | | | | |
|---|---|---|---|---|
| 3,636,894 A * | 1/1972 | Hage | A47B 3/06 108/156 |
| 3,713,397 A * | 1/1973 | Parker | B61F 3/04 105/136 |
| 4,760,799 A * | 8/1988 | Jackson | B61F 5/24 105/182.1 |
| 10,059,350 B2 * | 8/2018 | Drexler | B61F 5/02 |

FOREIGN PATENT DOCUMENTS

| | | |
|---|---|---|
| JP | 2005-138604 A | 6/2005 |
| JP | 2007-203917 A | 8/2007 |

* cited by examiner

*Primary Examiner* — Mark T Le
(74) *Attorney, Agent, or Firm* — Oliff PLC

(57) ABSTRACT

A restricting member is configured to restrict abnormal rising of a carbody when an air spring expands by a predetermined amount or more. The restricting member includes: a base portion; a contact portion provided at the base portion and configured to be brought into contact with a lower surface of a bogie frame when the air spring expands by the predetermined amount or more; and a temporary fastening portion formed at the base portion. The temporary fastening portion is configured to be attachable to and detachable from a temporary fastened portion formed at a side surface of a center pin extending downward from a carbody.

5 Claims, 5 Drawing Sheets

RESTRICTING MEMBER AND RAILCAR INCLUDING RESTRICTING MEMBER

BACKGROUND OF THE INVENTION

1. Field of the Invention

The present invention relates to a restricting member configured to restrict abnormal rising of an air spring in a railcar and a railcar including the restricting member.

2. Description of the Related Art

Conventionally, in railcars, an air spring is used as a buffer device provided between a bogie provided with wheels and a carbody provided at an upper portion of the bogie. The air spring can expand or contract in an upward/downward direction by supplying or discharging compressed air to or from an air chamber formed inside the air spring. In the railcars, for example, performed is an automatic level controlling operation of adjusting the pressure of the air in the air spring such that the height of the railcar is maintained within a certain range by utilizing the expansion and contraction of the air spring.

However, the air spring may cause abnormal rising, that is, the internal pressure of the air spring may increase by, for example, a failure of an air system, and therefore, the air spring may expand by a predetermined amount or more. On this account, the carbody is provided with a restricting member configured to mechanically restrict the rising of the carbody when the abnormal rising of the air spring occurs.

One example of this type of conventional art is a height stopper configured such that: a fitting recess is provided at a lower end of a center pin attached to the carbody; a coupling portion provided at a height stopper member (restricting member) is fitted into the fitting recess; and the coupling portion is fixed to the fitting recess by a bolt (see PTL 1, for example).

Another example of this type of conventional art is that a separation preventing device (restricting member) constituting a height stopper is attached to a lower portion of a center pin by a bolt, the center pin extending downward from the carbody (see PTL 2, for example).

PATENT LITERATURES

PTL 1: Japanese Laid-Open Patent Application Publication No. 2005-138604

PTL 2: Japanese Laid-Open Patent Application Publication No. 2007-203917

According to the restricting member, when the abnormal rising of the carbody relative to the bogie occurs, the restricting member provided at the carbody is brought into contact with the bogie to restrict the abnormal rising of the carbody. Therefore, when separating the carbody and the bogie from each other, the restricting member needs to be detached from the carbody.

However, the restricting member is designed so as to be able to support a load generated when high-pressure air is directly supplied to the air spring by, for example, the failure of the air system. Therefore, the restricting member is configured as a member having rigidity capable of supporting a large load. Since the weight of the restricting member is several tens of kilograms, an operator or the like cannot easily attach or detach the restricting member to or from the carbody. In addition, the restricting member is typically provided at a width-direction middle portion of the carbody. Therefore, work of attaching or detaching the restricting member to or from the carbody is work of putting a car into a pit track and performing attaching or detaching from under a floor of the car by the operator or the like facing upward. On this account, the operator or the like needs to perform such work while supporting the weight of the restricting member from below, so that the operator or the like cannot easily attach or detach the restricting member to or from the carbody. Both PTL 1 and PTL 2 have these problems.

An object of the present invention is to provide a restricting member configured to allow an operator or the like to easily perform work of attaching and detaching the restricting member to and from a carbody and a railcar including the restricting member.

SUMMARY OF THE INVENTION

To achieve the above object, a restricting member according to the present invention is a restricting member configured to restrict abnormal rising of a carbody when an air spring expands by a predetermined amount or more, the restricting member including: a base portion; a contact portion provided at the base portion and configured to be brought into contact with a lower surface of a bogie frame when the air spring expands by the predetermined amount or more; and a temporary fastening portion formed at the base portion, the temporary fastening portion being configured to be attachable to and detachable from a temporary fastened portion formed at a side surface of a center pin extending downward from the carbody.

According to this configuration, the temporary fastening portion formed at the base portion is temporarily fastened to the temporary fastened portion formed at the side surface of the center pin. With this, the restricting member can be temporarily fastened to the center pin. In a state where the weight of the restricting member is supported by the center pin, for example, the restricting member can be attached to the center pin by a bolt. Therefore, an operator or the like can easily attach the restricting member to the center pin provided at the carbody. Further, even when the bolt is removed from the restricting member from a state where the restricting member is attached to the center pin by the bolt, the temporary fastening portion formed at the base portion is being temporarily fastened to the temporary fastened portion formed at the side surface of the center pin extending downward from the carbody. Therefore, the operator or the like can easily attach or detach the restricting member to or from the center pin provided at the carbody.

According to the present invention, the operator or the like can perform work of attaching or detaching the restricting member from a state where the restricting member is temporarily fastened to the center pin. Therefore, the operator or the like can easily attach or detach the restricting member to or from the center pin provided at the carbody.

DESCRIPTION OF THE PREFERRED EMBODIMENTS

Hereinafter, embodiments will be explained based on the drawings. In the following explanation, a direction in which a railcar travels, that is, a length direction in which a carbody extends is defined as a car longitudinal direction, and a crosswise direction orthogonal to the car longitudinal direction is defined as a car width direction (It should be noted that the car longitudinal direction is also referred to as a forward/rearward direction, and the car width direction is also referred to as a leftward/rightward direction.). Further, in the following explanation and drawings, the same reference signs are used for the same components.

Figure 1:
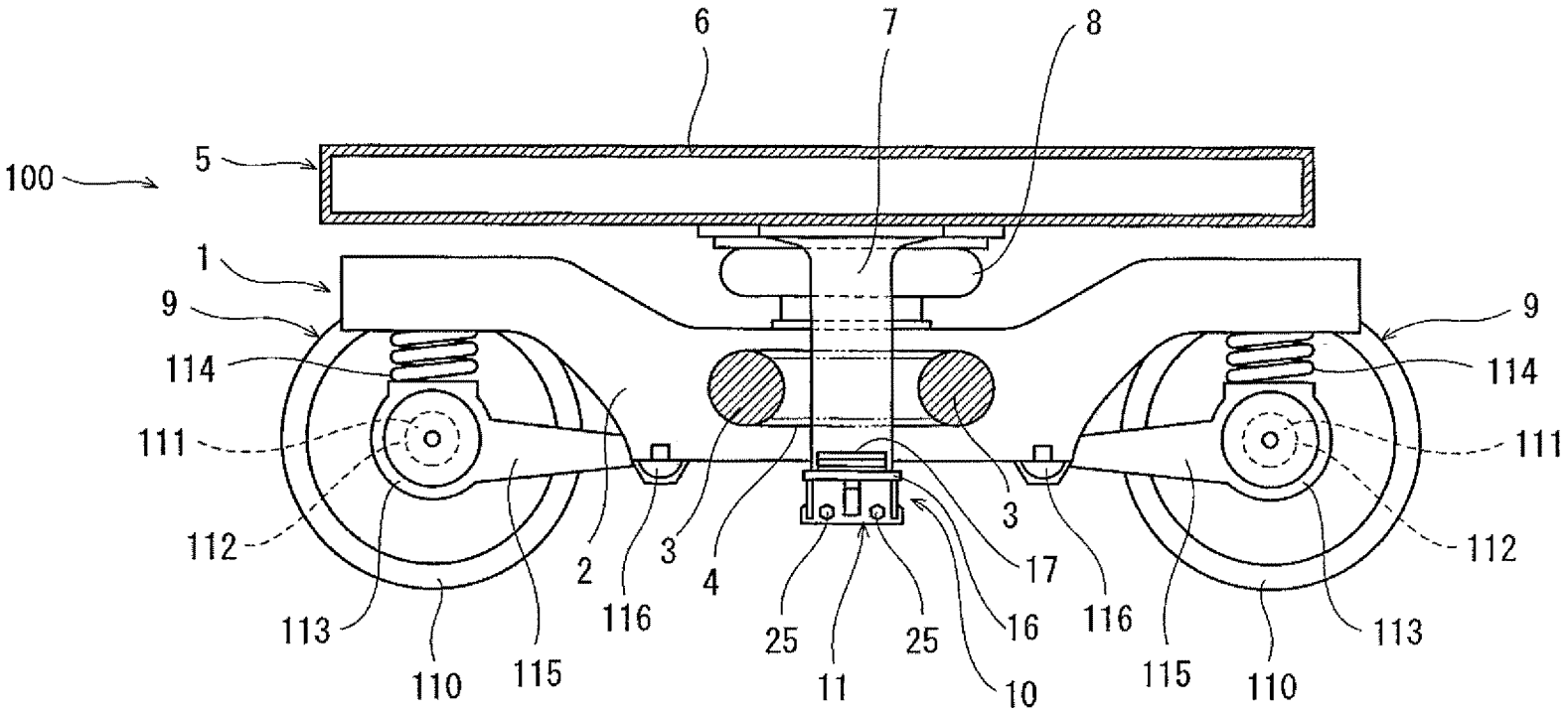
FIG. 1 is a cross-sectional view showing a part of a carbody including a height stopper and a part of a bogie in a side view.

FIG. 1 is a cross-sectional view showing a part of a bogie 1 including a height stopper 10 and a part of a carbody 5 in a side view. FIG. 1 shows only a part of the bogie 1 and a part of the carbody 5 in a railcar 100. The bogie 1 includes a bogie frame 4 and wheelsets 9. The bogie frame 4 includes side sills 2 and a cross beam 3 coupling the side sills 2 to each other. The wheelsets 9 are provided at both respective car longitudinal direction sides of each of the side sills 2. Each of the wheelsets 9 is constituted by an axle 111 extending in the car width direction and wheels 110 provided at both respective end portions of the axle 111. Both end portions of the axle 111 are rotatably supported by respective bearings 112, and the bearings 112 are accommodated in an axle box 113. An axle box suspension 114 including a coil spring (axle spring) is interposed between the axle box 113 and each of both car longitudinal direction end portions of the side sill 2. An axle beam 115 extends from the axle box 113 toward a middle side of the bogie 1, and an end portion of the axle beam 115 is elastically coupled to the side sill 2 through a rubber bushing 116 and the like. Further, the carbody 5 includes a carbody frame 6 and a center pin 7 fixed so as to extend downward from the carbody frame 6. A traction device for traction of the carbody 5 by the bogie 1 is provided at the center pin 7. An air spring 8 as a secondary suspension is provided between the side sill 2 of the bogie frame 4 and the carbody frame 6 of the carbody 5.

The height stopper 10 is provided at a lower portion of the center pin 7. The height stopper 10 includes restricting members 11 each configured to restrict abnormal rising of the carbody 5 when the air spring 8 expands by a predetermined amount or more. The restricting members 11 are attached to respective left and right car width direction side surfaces of the center pin 7. The restricting member 11 of the present embodiment is attached to the center pin 7 by fixing bolts 25 from the car width direction. As described below, the restricting member 11 is brought into contact with a lower surface of the bogie frame 4 (in FIG. 1, a near side of the center pin 7 is shown by two-dot chain lines) of the bogie 1 to stop the rising of the center pin 7 (carbody 5).

Embodiment 1

Figure 2:
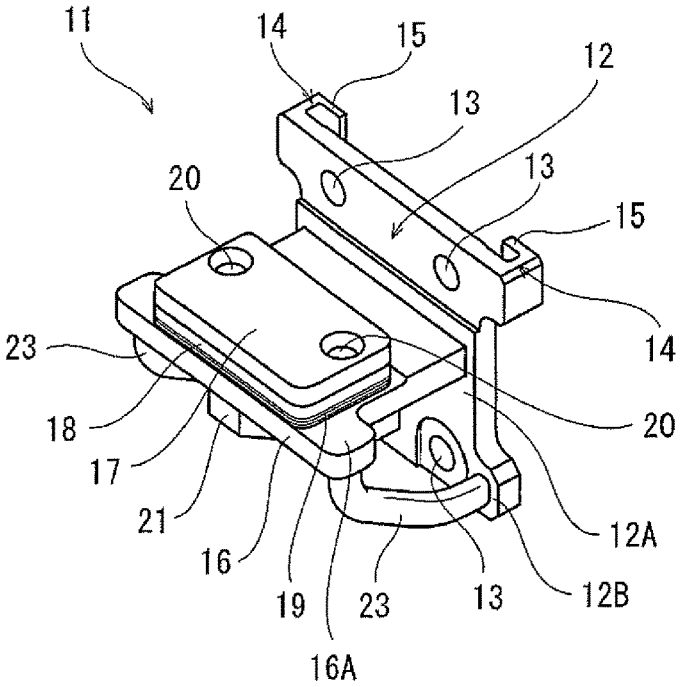
FIG. 2 is a perspective front view showing a restricting member of the height stopper according to Embodiment 1 when viewed obliquely from above.
Figure 3:
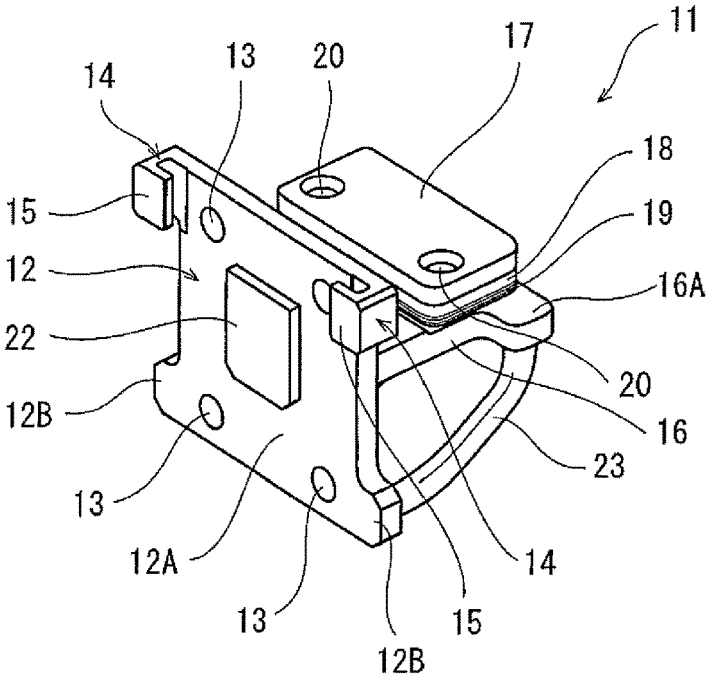
FIG. 3 is a perspective rear view showing the restricting member of FIG. 2 when viewed obliquely from above.

FIG. 2 is a perspective front view showing the restricting member 11 according to Embodiment 1 when viewed obliquely from above. FIG. 3 is a perspective rear view showing the restricting member 11 when viewed obliquely from above. As shown in FIGS. 2 and 3, the restricting member 11 of the present embodiment includes a base portion 12 and a contact portion 16. The contact portion 16 projects from the base portion 12 outward in the car width direction. When the air spring 8 expands by the predetermined amount or more, the contact portion 16 is brought into contact with the lower surface of the bogie frame 4 of the bogie 1 to restrict the abnormal rising of the carbody 5.

The base portion 12 is formed in a flat plate shape. The base portion 12 includes bolt holes 13 for fixing the base portion 12 to the center pin 7 by the fixing bolts 25. A resin member 17 is provided at a portion of the contact portion 16 so as to contact the bogie frame 4. Engineering plastic such as polyacetal resin may be used as the resin member 17. The resin member 17 is fixed to a metal member 18. A plurality of metal plates 19 (shim members) for adjusting an interval between the bogie frame 4 and the resin member 17 are provided under the metal member 18. The metal member 18 and the metal plates 19 are fixed to the contact portion 16 by bolts 20. A reinforcing member 21 is obliquely provided between a lower surface of the contact portion 16 and an outer surface of the base portion 12.

The base portion 12 includes temporary fastening portions 14 capable of temporarily fastening the base portion 12 to temporary fastened portions 32 (FIG. 5) formed at a side surface 30 of the center pin 7 (carbody 5). The temporary fastening portions 14 of the present embodiment include respective locking portions 15 projecting from an upper portion of the base portion 12 in a direction opposite to the contact portion 16. The locking portions 15 project from both respective left and right end portions of the base portion 12 in the direction opposite to the contact portion 16. Tip ends of the locking portions 15 extend inward, and each of the tip ends is formed in a flat plate shape parallel to the base portion 12. As described below, the locking portions 15 can be locked to respective grooves 33 that are the temporary fastened portions 32 formed at the side surface 30 (FIG. 5) of the center pin 7.

A load transfer portion 22 projecting in a direction opposite to a direction in which the contact portion 16 projects is formed at a surface (rear surface) of the base portion 12, the rear surface being opposite to a surface at which the contact portion 16 is provided. The load transfer portion 22 of the present embodiment is formed in a rectangular block shape projecting from the base portion 12 by a predetermined height. In a side view, the load transfer portion 22 and the contact portion 16 are provided at respective positions symmetrical with respect to the base portion 12. As described below, the load transfer portion 22 engages with a recess 34 (FIG. 7) provided at the side surface 30 of the center pin 7. The load transfer portion 22 causes the center pin 7 (carbody 5) to receive reaction force of a load F acting on the contact portion 16.

By providing the load transfer portion 22, the load acting on the contact portion 16 can be received by the recess 34 of the side surface 30 of the center pin 7 through the load transfer portion 22 of the base portion 12. By the load transfer portion 22, the load at the time of the abnormal rising can be prevented from acting as a shear force on the fixing bolts 25 for fixing the base portion 12 to the carbody 5.

Figure 4:
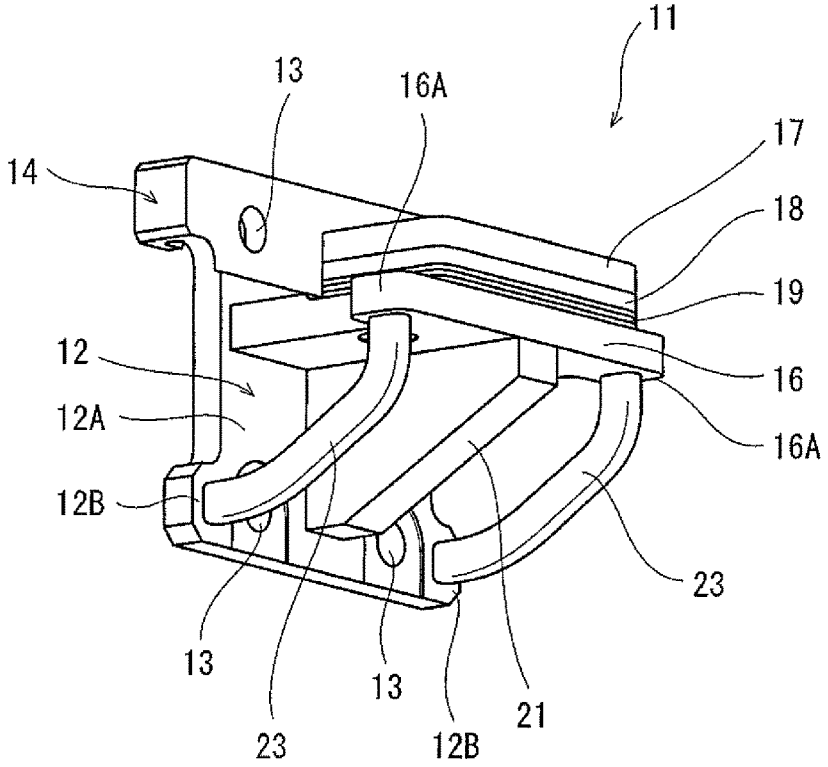
FIG. 4 is a perspective front view showing the restricting member of FIG. 2 when viewed obliquely from below.

FIG. 4 is a perspective front view showing the restricting member 11 when viewed obliquely from below. The restricting member 11 of the present embodiment is provided with handle portions 23 which allow an operator or the like to lift the restricting member 11 from below. To allow the operator or the like to easily hold the restricting member 11, the handle portions 23 that are members each having an oval cross section are provided at two respective positions that are away from each other in a crosswise direction. In the present embodiment, each of the handle portions 23 is obliquely provided so as to connect the lower surface of the contact portion 16 and an extending portion 12A of the base portion 12, the extending portion 12A extending downward.

Projecting portions 12B project from the extending portion 12A toward both respective sides, and projecting portions 16A project from the contact portion 16 toward both respective sides. Each of the handle portions 23 is fixed to the corresponding projecting portion 12B and the corresponding projecting portion 16A. As above, the handle portions 23 are attached to both sides of the extending portion 12A and both sides of the contact portion 16, the extending portion 12A and the contact portion 16 being middle portions that receive the load at the time of the abnormal rising.

When the operator or the like attach or detach the restricting member 11 to or from the side surface of the center pin 7, the operator or the like can perform such work while holding the handle portions 23. Since the operator or the like holds the handle portions 23, he/she can temporarily fasten the restricting member 11 to the center pin 7 while supporting the weight of the restricting member 11 from under a floor of the carbody. Therefore, the operator or the like can easily attach or detach the restricting member 11 to or from the side surface of the center pin 7.

Figure 5:
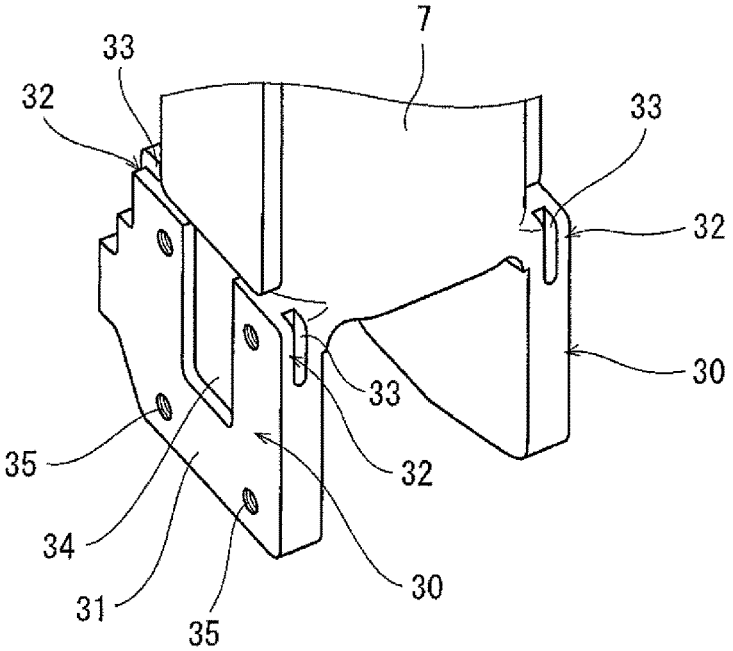
FIG. 5 is a perspective view showing a center pin to which the restricting member of FIG. 2 is attached.

FIG. 5 is a perspective view showing the center pin 7 to which the restricting member 11 is attached. The side surfaces 30 are formed at a lower end of the center pin 7, and the restricting members 11 are attached to the respective side surfaces 30 so as to be line-symmetrical with respect to a center of the center pin 7. The side surfaces 30 are formed apart from each other in the car width direction of the bogie 1. Each of the side surfaces 30 includes a fixing surface 31 to which the base portion 12 of the restricting member 11 is fixed by the fixing bolts 25. The fixing surface 31 is a contact surface with which the base portion 12 contacts. Bolt holes 35 in which the fixing bolts 25 are screwed are provided at two upper positions and two lower positions at the fixing surface 31.

The temporary fastened portions 32 are formed at an upper portion of the side surface 30, and the temporary fastening portions 14 of the restricting member 11 are temporarily fastened to the respective temporary fastened portions 32. The temporary fastened portions 32 are the grooves 33 each of which is open only at an upper side and extends in a vertical direction. The locking portion 15 provided at the temporary fastening portion 14 is inserted into the groove 33 from above to be locked to the groove 33. The recess 34 is formed at the fixing surface 31 (surface) of the side surface 30, and the load transfer portion 22 formed at the rear surface of the base portion 12 engages with the recess 34.

Figure 6:
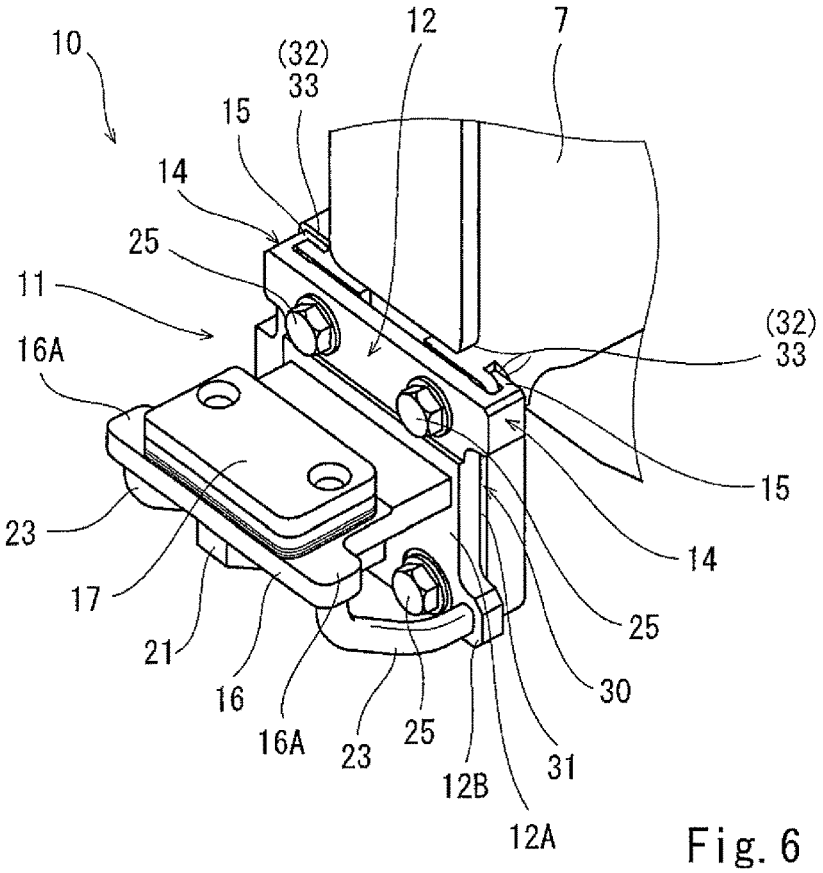
FIG. 6 is a perspective view showing a state where the restricting member of FIG. 2 is attached to a side surface of the center pin of FIG. 5.
Figure 7:
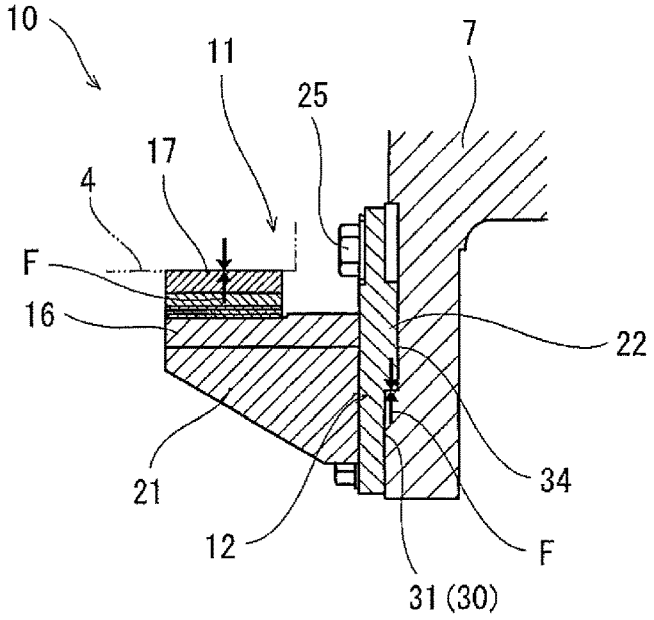
FIG. 7 is a central longitudinal sectional view showing a state where the restricting member according to Embodiment 1 shown in FIG. 6 is attached to the center pin.

FIG. 6 is a perspective view showing a state where the restricting member 11 is attached to the side surface 30 of the center pin 7. FIG. 7 is a central longitudinal sectional view showing a state where the restricting member 11 of FIG. 6 is attached to the center pin 7. As shown in FIGS. 6 and 7, the height stopper 10 of Embodiment 1 is configured such that the restricting member 11 is attached to the center pin 7. According to the restricting member 11, when the operator or the like attaches the restricting member 11 to the center pin 7 (carbody 5), the locking portions 15 of the temporary fastening portions 14 of the base portion 12 are locked to the grooves 33 of the temporary fastened portions 32 of the side surface 30 of the center pin 7. By locking the locking portions 15 to the grooves 33, the restricting member 11 can be temporarily fastened to the center pin 7 (carbody 5). Therefore, the operator or the like can fix the restricting member 11 to the side surface of the center pin 7 from a state where the restricting member 11 is temporarily fastened to the center pin 7.

Specifically, when attaching the restricting member 11 to the center pin 7, the operator or the like holds the left and right handle portions 23 with his/her hands and inserts the locking portions 15 of the base portion 12 into the grooves 33 that are the temporary fastened portions 32 of the side surface 30. With this, the temporary fastening portions 14 are locked to the temporary fastened portions 32. Therefore, even when the operator takes his/her hands off from the restricting member 11, the weight of the restricting member 11 is supported by the center pin 7. Thus, the restricting member 11 can be temporarily fastened to the center pin 7. On this account, the operator can fix the restricting member 11 to the center pin 7 by the fixing bolts 25 without supporting the restricting member 11.

When the temporary fastening portions 14 of the restricting member 11 are locked to the respective temporary fastened portions 32 of the center pin 7, the base portion 12 is located at a fixing position where the base portion 12 is fixed to the side surface 30 by the fixing bolts 25. Therefore, the restricting member 11 can be fixed to the side surface 30 by the fixing bolts 25 from a state where the restricting member 11 is temporarily fastened to the side surface 30. On this account, the operator or the like can easily fix the restricting member 11 to the center pin 7.

Further, when the temporary fastening portions 14 are temporarily fastened to the temporary fastened portions 32, the load transfer portion 22 provided at the rear surface of the base portion 12 contacts a lower end of the recess 34 provided at the surface of the side surface 30 (FIG. 7). Therefore, the reaction force of the large load F applied from the bogie frame 4 to the contact portion 16 of the restricting member 11 at the time of the abnormal rising of the air spring can be received by the recess 34 of the side surface 30 contacting the load transfer portion 22 of the base portion 12. On this account, the load F at the time of the abnormal rising of the air spring can be prevented from acting on the fixing bolts 25. With this, the fixing bolts 25 are only required to have such strength that can maintain a fixed state of the restricting member 11 fixed to the center pin 7. The fixing bolts 25 do not have to have such strength that can support the load at the time of the abnormal rising of the air spring.

When detaching the restricting member 11 from the center pin 7, the fixing bolts 25 are detached from the restricting member 11. Even when the fixing bolts 25 are detached from the restricting member 11, the temporary fastening portions 14 of the restricting member 11 are being temporarily fastened to the respective temporary fastened portions 32. Therefore, the operator or the like does not have to support the restricting member 11. The operator or the like holds the left and right handle portions 23 with his/her hands and pulls out the locking portions 15 of the temporary fastening portions 14 upward from the grooves 33 that are the temporary fastened portions 32. With this, the restricting member 11 can be detached from the center pin 7. Therefore, the operator or the like can easily detach the restricting member 11 from the center pin 7.

On this account, according to the height stopper 10, when the operator or the like attaches or detaches the restricting member 11 to or from the center pin 7 of the carbody 5, the restricting member 11 can be temporarily fastened to the center pin 7 of the carbody 5 by the temporary fastening portions 14 formed at the base portion 12 of the restricting member 11. Thus, the operator or the like can attach or detach the restricting member 11 to or from the center pin 7 from a state where the weight of the restricting member 11 is supported by the center pin 7 (carbody 5). Therefore, the operator or the like can easily attach or detach the restricting member 11 to or from the center pin 7.

In the present embodiment, the load transfer portion 22 is provided at the rear surface of the base portion 12 and engages with the recess 34 provided at the surface (fixing surface 31) of the side surface 30, and the load F at the time of the abnormal rising is supported. However, the configuration of the load transfer portion 22 is not limited to this. The load transfer portion 22 may not be provided at the rear surface of the base portion 12, and the load F at the time of the abnormal rising may be supported by the locking portions 15 and the fixing bolts 25. The configuration that supports the load F at the time of the abnormal rising is not limited to these examples.

Embodiment 2

Figure 8:
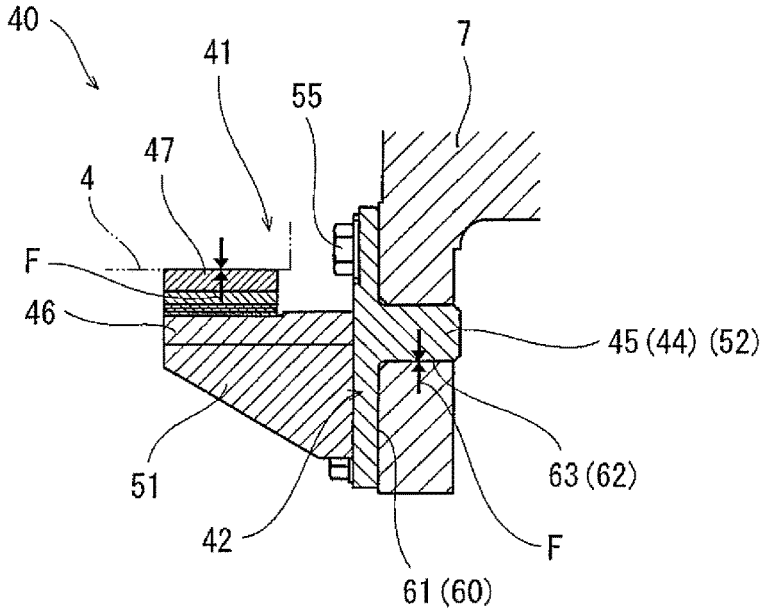
FIG. 8 is a central longitudinal sectional view showing a state where the restricting member according to Embodiment 2 is attached to the center pin.

FIG. 8 is a central longitudinal sectional view showing a height stopper 40 including a restricting member 41 according to Embodiment 2. In Embodiment 2, regarding components that are the same as the components of the restricting member 11 of the height stopper 10 of Embodiment 1, reference signs each obtained by adding "30" to the reference sign of the corresponding component of Embodiment 1 are used. In addition, regarding components that are the same as the components of the side surface 30 of Embodiment 1, reference signs each obtained by adding "30" to the reference sign of the corresponding component of Embodiment 1 are used. In FIG. 8, the handle portion 23 is not shown.

In the height stopper 40 including the restricting member 41 of Embodiment 2, a temporary fastening portion 44 of the restricting member 41 is provided at a rear surface of a base portion 42. The temporary fastening portion 44 is configured as a shaft portion 45 extending in a horizontal direction toward a side surface 60. Further, a hole portion 63 that is a temporary fastened portion 62 is formed at a middle portion of a fixing surface 61 of the side surface 60 so as to extend in the horizontal direction. The hole portion 63 is formed to have such a size that the shaft portion 45 can be inserted into the hole portion 63. In Embodiment 2, the shaft portion 45 also serves as a load transfer portion 52.

According to the restricting member 41 of Embodiment 2, by inserting the shaft portion 45 of the base portion 42 into the hole portion 63 of the side surface 60, the weight of the restricting member 41 can be supported by the side surface 60 of the center pin 7. Therefore, the restricting member 41 can be temporarily fastened to the center pin 7 by a simple configuration.

On this account, according to the restricting member 41, when attaching the restricting member 41 to the center pin 7, the shaft portion 45 that is the temporary fastening portion 44 provided at the base portion 42 of the restricting member 41 is inserted into the hole portion 63 provided at the side surface 60 of the center pin 7. By inserting the shaft portion 45 into the hole portion 63, the restricting member 41 can be temporarily fastened to the center pin 7. Therefore, the operator or the like can easily perform work of attaching the restricting member 41 to the center pin 7 by a fixing bolt 55 from a state where the weight of the restricting member 41 is temporarily fastened to the center pin 7 (carbody 5). On this account, the operator or the like can easily attach the restricting member 41 to the center pin 7.

When detaching the restricting member 41 from the center pin 7, the operator or the like removes the fixing bolt 55. Even when the fixing bolt 55 is removed, the shaft portion 45 provided at the base portion 42 of the restricting member 41 is being inserted into the hole portion 63 of the side surface 60. Therefore, it is possible to maintain a state where the weight of the restricting member 41 is supported by the center pin 7, and the restricting member 41 is temporarily fastened to the center pin 7. Thus, the operator or the like can detach the restricting member 41 from the center pin 7 from a state where the restricting member 41 is temporarily fastened to the center pin 7. On this account, the operator or the like can easily detach the restricting member 41 from the center pin 7.

Further, the reaction force of the large load F received by a contact portion 46 of the restricting member 41 at the time of the abnormal rising of the air spring can be received by the hole portion 63 through the shaft portion 45 also serving as the load transfer portion 52, the hole portion 63 being the temporary fastened portion 62 of the side surface 60. In addition, when the temporary fastening portion 44 of the restricting member 41 is locked to the temporary fastened portion 62 of the side surface 60, the base portion 42 is located at a fixing position where the base portion 42 is fixed to the side surface 60 by the fixing bolt 55. Therefore, the load F at the time of the abnormal rising of the air spring does not act on the fixing bolt 55. With this, the fixing bolt 55 is only required to have such strength that can maintain the fixed state of the restricting member 41 fixed to the center pin 7. The fixing bolt 55 does not have to have such strength that can support the load at the time of the abnormal rising of the air spring.

Embodiment 3

Figure 9:
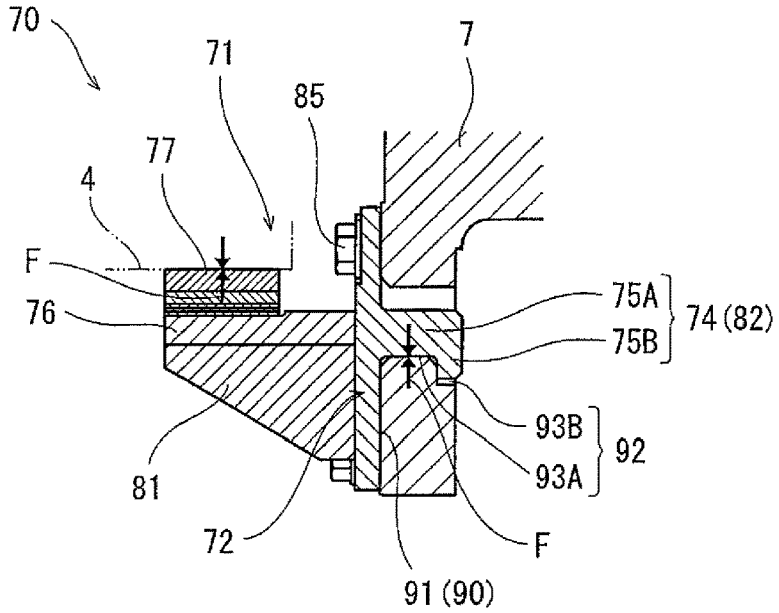
FIG. 9 is a central longitudinal sectional view showing a state where the restricting member according to Embodiment 3 is attached to the center pin.

FIG. 9 is a central longitudinal sectional view showing a height stopper 70 according to Embodiment 3. In Embodiment 3, regarding components that are the same as the components of the restricting member 41 of the height stopper 40 of Embodiment 2, reference signs each obtained by adding "30" to the reference sign of the corresponding component of Embodiment 2 are used. In addition, regarding components that are the same as the components of the side surface 60 of Embodiment 2, reference signs each obtained by adding "30" to the reference sign of the corresponding component of Embodiment 2 are used. In FIG. 9, the handle portion 23 is not shown.

In the height stopper 70 of Embodiment 3, a temporary fastening portion 74 of a restricting member 71 is provided at a rear surface of a base portion 72. The temporary fastening portion 74 includes: a shaft portion 75A projecting in the horizontal direction to a predetermined position inside the center pin 7; and a projecting portion 75B projecting downward from one end of the shaft portion 75A. Further, a temporary fastened portion 92 is provided at a middle portion of a fixing surface 91 of a side surface 90. The temporary fastened portion 92 includes: a hole portion 93A extending in the horizontal direction; and a hole portion 93B spreading downward from a predetermined position of the hole portion 93A. The hole portion 93A is formed to have such a size that the temporary fastening portion 74 can be inserted into the hole portion 93A. The hole portion 93B is provided at a position where the projecting portion 75B is locked. In Embodiment 3, the shaft portion 75A also serves as a load transfer portion 82.

Therefore, according to the height stopper 70, when the operator or the like attaches the restricting member 71 to the center pin 7, the shaft portion 75A that is the temporary fastening portion 74 provided at the base portion 72 of the restricting member 71 is inserted into the hole portion 93A that is the temporary fastened portion 92 provided at the side surface 90 of the center pin 7. Then, the projecting portion 75B projecting downward from the shaft portion 75A is hooked to the hole portion 93B spreading downward from the predetermined position of the hole portion 93A. With this, the weight of the restricting member 71 is supported by the side surface 90 through the shaft portion 75A. Then, in a state where the posture of the restricting member 71 is maintained by the projecting portion 75B, the restricting member 71 can be temporarily fastened to the center pin 7. Therefore, in a state where the weight of the restricting member 71 is supported by the center pin 7 (carbody 5), and the restricting member 71 is temporarily fastened to the center pin 7 (carbody 5), the operator or the like can easily perform the work of attaching the restricting member 71 to the center pin 7 by the fixing bolt 85. On this account, the operator or the like can easily attach the restricting member 71 to the center pin 7.

When detaching the restricting member 71 from the center pin 7, the operator or the like removes the fixing bolt 85. Even when the fixing bolt 85 is removed, the projecting portion 75B of the shaft portion 75A provided at the base portion 72 of the restricting member 71 is being hooked to the hole portion 93B spreading downward from the predetermined position of the hole portion 93A of the side surface 90. Therefore, it is possible to maintain a state where the weight of the restricting member 71 is supported by the center pin 7, and the restricting member 71 is temporarily fastened to the center pin 7. Thus, the operator or the like can detach the restricting member 71 from the center pin 7 from a state where the restricting member 71 is temporarily fastened to the center pin 7. On this account, the operator or the like can easily detach the restricting member 71 from the center pin 7.

Further, the reaction force of the large load F received by a contact portion 76 of the restricting member 71 at the time of the abnormal rising of the air spring can be received by the hole portion 93A through the shaft portion 75A also serving as the load transfer portion 82, the hole portion 93A being the temporary fastened portion 92 of the side surface 90. In addition, when the temporary fastening portion 74 of the restricting member 71 is locked to the temporary fastened portion 92 of the side surface 90, the base portion 72 is located at a fixing position where the base portion 72 is fixed to the side surface 90 by the fixing bolt 85. Therefore, the load F at the time of the abnormal rising of the air spring does not act on the fixing bolt 85. With this, the fixing bolt 85 is only required to have such strength that can maintain the fixed state of the restricting member 71. The fixing bolt 85 does not have to have such strength that can support the load at the time of the abnormal rising of the air spring.

It should be noted that each of the temporary fastening portions 14, 44, and 74 and the temporary fastened portions 32, 62, and 92 in the above embodiments is just one example. The temporary fastening portions 14, 44, and 74 and the temporary fastened portions 32, 62, and 92 are only required to be configured such that when attaching or detaching the restricting member 11, 41, or 71, the weight of the restricting member 11, 41, or 71 can be supported by the side surface 30, 60, or 90 of the center pin 7. The temporary fastening portions 14, 44, and 74 and the temporary fastened portions 32, 62, and 92 are not limited to the above embodiments. Further, for example, the handle portion 23 may also serve as the reinforcing member 21.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

REFERENCE SIGNS LIST

1 bogie
4 bogie frame
5 carbody
7 center pin
8 air spring
10 height stopper
11 restricting member
12 base portion
14 temporary fastening portion
15 locking portion
16 contact portion
22 load transfer portion
23 handle portion
30 side surface
32 temporary fastened portion
33 groove
34 recess
40 height stopper
41 restricting member
42 base portion
44 temporary fastening portion
45 shaft portion
46 contact portion
52 load transfer portion
60 side surface
62 temporary fastened portion
63 hole portion
70 height stopper
71 restricting member
72 base portion
74 temporary fastening portion
75A shaft portion
75B projecting portion
76 contact portion
82 load transfer portion
90 side surface
92 temporary fastened portion
93A hole portion
93B hole portion
100 railcar

What is claimed is:

1. A restricting member configured to restrict abnormal rising of a carbody when an air spring expands by a predetermined amount or more, the restricting member comprising:

a base portion;

a contact portion provided at the base portion and configured to be brought into contact with a lower surface of a bogie frame when the air spring expands by the predetermined amount or more; and a temporary fastening portion formed at the base portion, the temporary fastening portion being configured to be attachable to and detachable from a temporary fastened portion formed at a side surface of a center pin extending downward from the carbody, and the temporary fastening portion includes one or more locking portions, each locked to a respective groove, each respective groove being provided at at least one of respective forward and rearward direction side surfaces of the center pin, each respective groove being open only at an upper side, and each respective groove serving as the temporary fastened portion.

2. A restricting member configured to restrict abnormal rising of a carbody when an air spring expands by a predetermined amount or more, the restricting member comprising:

a base portion;

a contact portion provided at the base portion and configured to be brought into contact with a lower surface of a bogie frame when the air spring expands by the predetermined amount or more; and a temporary fastening portion formed at the base portion, the temporary fastening portion being configured to be attachable to and detachable from a temporary fastened portion formed at a side surface of a center pin extending downward from the carbody, wherein the temporary fastening portion is a shaft portion inserted into a hole portion, the hole portion being provided at the center pin, the hole portion extending in a horizontal direction, and the hole portion serving as the temporary fastened portion.

3. The restricting member according to claim 2, wherein:

one end of the shaft portion extends in the horizontal direction to a predetermined position inside the center pin from a contact surface where the base portion contacts the center pin; and the one end of the shaft portion includes a projecting portion projecting downward toward the hole portion spreading downward from the predetermined position.

4. A restricting member configured to restrict abnormal rising of a carbody when an air spring expands by a predetermined amount or more, the restricting member comprising:

a base portion;

a contact portion provided at the base portion and configured to be brought into contact with a lower surface of a bogie frame when the air spring expands by the predetermined amount or more; and a temporary fastening portion formed at the base portion, the temporary fastening portion being configured to be attachable to and detachable from a temporary fastened portion formed at a side surface of a center pin extending downward from the carbody; and a handle portion connecting an extending portion of the base portion and a lower surface of the contact portion, the extending portion extending downward along the center pin.

5. A railcar comprising:

a carbody;

a bogie;

an air spring provided between the carbody and a bogie frame of the bogie;

a center pin extending downward in a vertical direction from a center portion of the carbody and allowing the bogie to rotate relative to the carbody;

a temporary fastened portion formed at a side surface of the center pin; and a restricting member, the restricting member including a base portion, a contact portion provided at the base portion and configured to be brought into contact with a lower surface of the bogie frame when the air spring expands by a predetermined amount or more, and a temporary fastening portion formed at the base portion, the temporary fastening portion being configured to be attachable to and detachable from the temporary fastened portion.

* * * * *